United States Patent [19]

Chow

[11] Patent Number: 5,036,975

[45] Date of Patent: Aug. 6, 1991

[54] TOOL BOX HAVING A RETAINING DEVICE

[76] Inventor: Jessie Chow, No. 15-30, Kuang Ming Rd., Hsi Twen Chu, Taichung, Taiwan

[21] Appl. No.: 615,887

[22] Filed: Nov. 20, 1990

[51] Int. Cl.[5] ..... B65D 85/28

[52] U.S. Cl. ..... 206/376; 206/372; 206/373; 312/DIG. 33

[58] Field of Search ..... 206/372, 376, 377, 373, 206/375, 477; 312/DIG. 33

[56] References Cited

U.S. PATENT DOCUMENTS

| | | | |
|---|---|---|---|
| 3,370,696 | 2/1968 | Groe | 206/376 X |
| 3,702,136 | 11/1972 | Albertson | 206/376 X |
| 4,449,629 | 5/1984 | Barrieau | 206/373 X |
| 4,705,168 | 11/1987 | Ward | 206/376 X |
| 4,836,374 | 6/1989 | Hutchins et al. | 206/373 |
| 4,911,297 | 3/1990 | Suburu | 206/372 X |

*Primary Examiner*—David T. Fidei
*Assistant Examiner*—Bethanne C. Cicconi
*Attorney, Agent, or Firm*—Merchant, Gould, Smith, Edell, Welter & Schmidt

[57] ABSTRACT

A tool box includes two casings having one end connected together by a flexible element and the other end coupled together by a retaining member. A number of slots are formed in each casing for receiving a number of tools. A retaining device has two legs resiliently coupled together by a retaining portion. The free ends of the legs are rotatably engaged to the casings. The retaining portion is engageable to the casing in order to retain the retaining device in place. A number of bent portions are formed on the legs of the retaining device and are arranged such that the bent portions press the tools in place.

4 Claims, 4 Drawing Sheets

TOOL BOX HAVING A RETAINING DEVICE

BACKGROUND OF THE INVENTION

The present invention relates to a tool box, and more particularly to a tool box having a retaining device for retaining tools.

Generally, a tool box is provided for receiving a plurality of tools therein so that the tools can be easily carried and transported. However, the tools are generally loosely received within cavities formed within the tool box and can not be stably retained within the tool box.

The present invention has arisen to mitigate and/or obviate the afore-described disadvantages of the conventional tool boxes.

SUMMARY OF THE INVENTION

The primary objective of the present invention is to provide a tool box having a retaining device for stably retaining tools accommodated in the tool box.

In accordance with one aspect of the invention, there is provided a tool box which comprises two casings having one end connected together by a flexible element so that the casings are foldable and the other end coupled together by a retaining member. A number of slots are laterally formed in an upper surface of each casing for receiving a number of tools. An opening is formed in a free end of each casing. Two holes are formed in an inner end of each casing. A retaining device includes two legs resiliently coupled together by a retaining portion. The free end of each leg is engageable within one of the holes so that the retaining device is rotatable about the free ends of the legs. The retaining portion is engageable within the opening so that the retaining device can be retained in place. A number of bent portions are formed on the legs of the retaining device and are arranged such that the bent portions will be engaged within the slots of the casings in order to press the tools in place.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
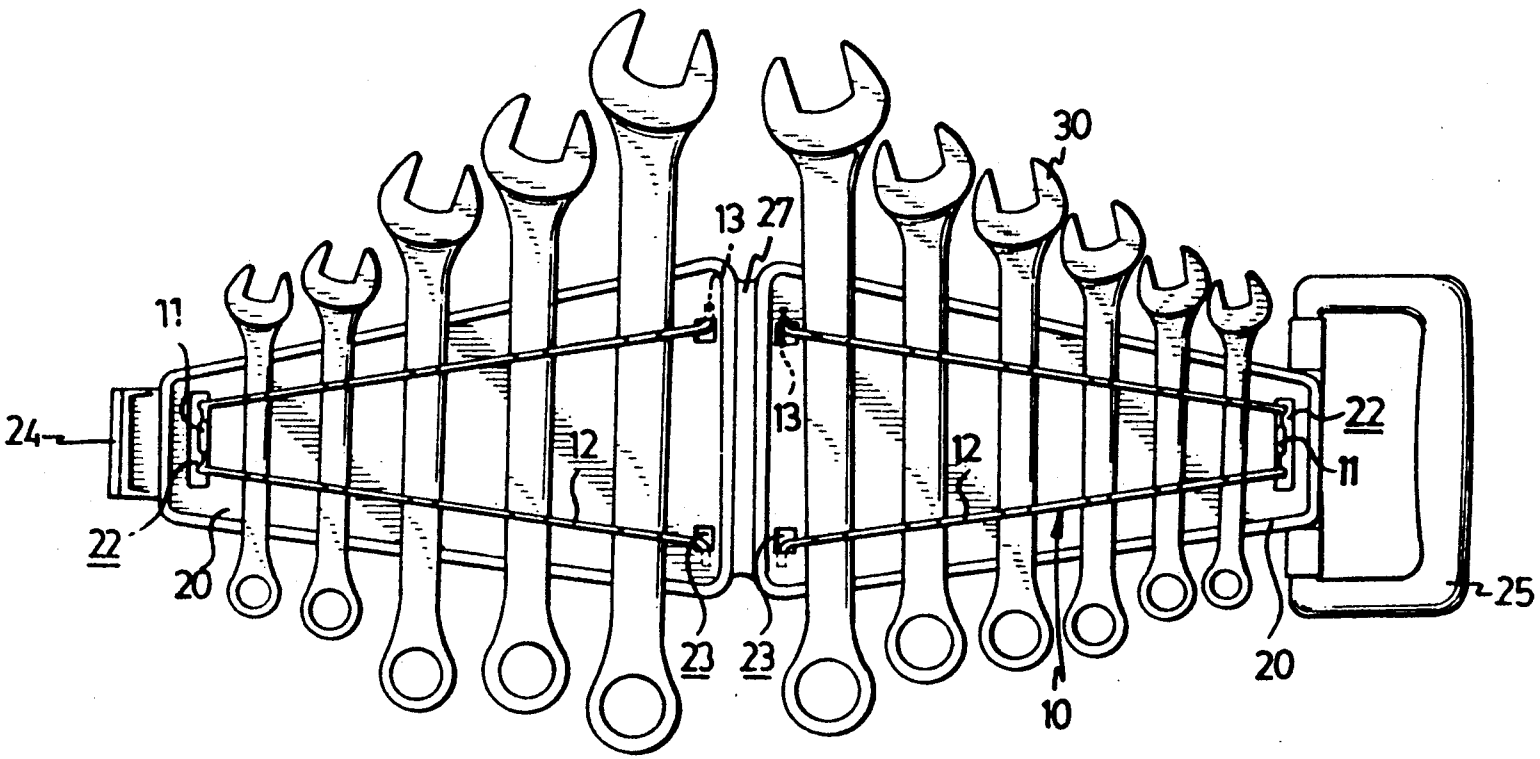
FIG. 1 is a top elevational view of a tool box having a retaining device in accordance with the present invention, in which the tool box is opened.

Referring to FIG. 1, the tool box in accordance with the present invention comprises generally a pair of casings 20 coupled together by a flexible element 27 so that the casings 20 can be folded to a position facing each other and close together. A retaining member 24 is disposed on the free end of one of the casings 20 and is engageable with a retaining member (not shown) on the free end of another housing 20 so that the two casings 20 can be coupled together. The retaining member 24 has been widely used in the tool boxes for retaining two casings thereof together and will not be described with further details. A grip 25 is provided on the free end of one of the casings 20 so that the tool box can be easily carried and transported when the two casings are coupled together. A retaining device 10 is provided for stably retaining a plurality of tools, such as wrenches 30 within the tool box.

Figure 2:
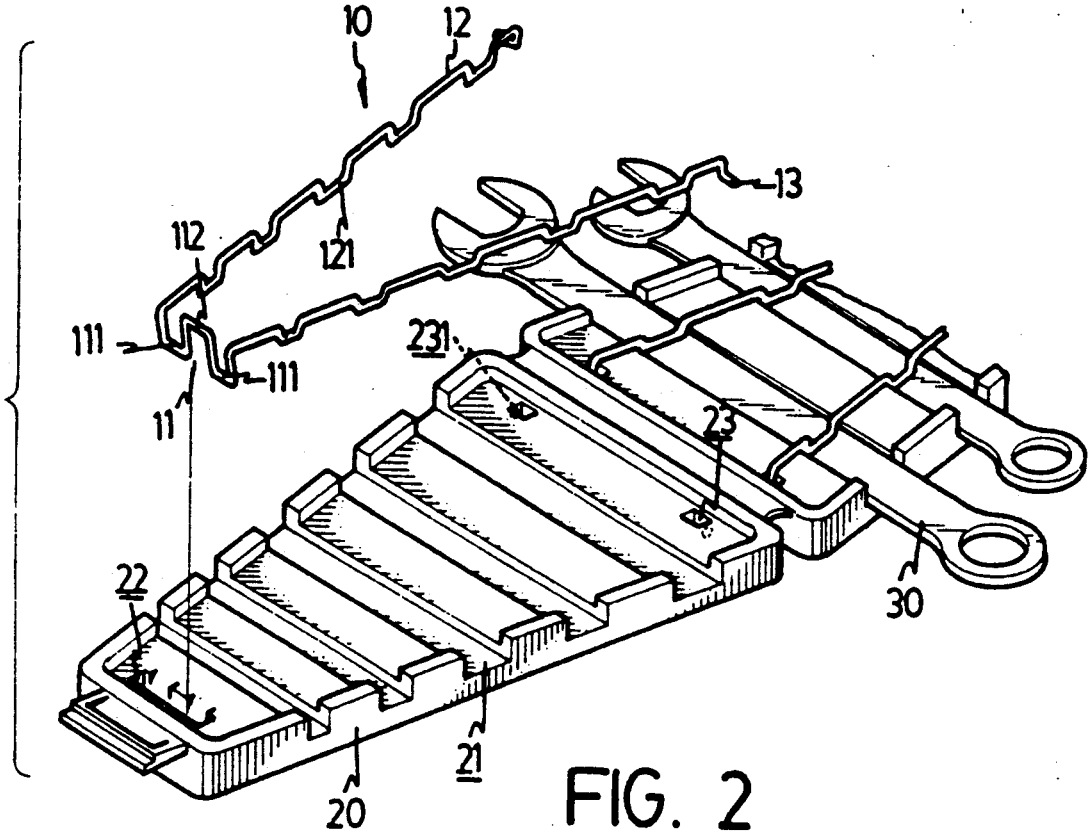
FIG. 2 is a partial exploded view of the tool box.
Figure 3:
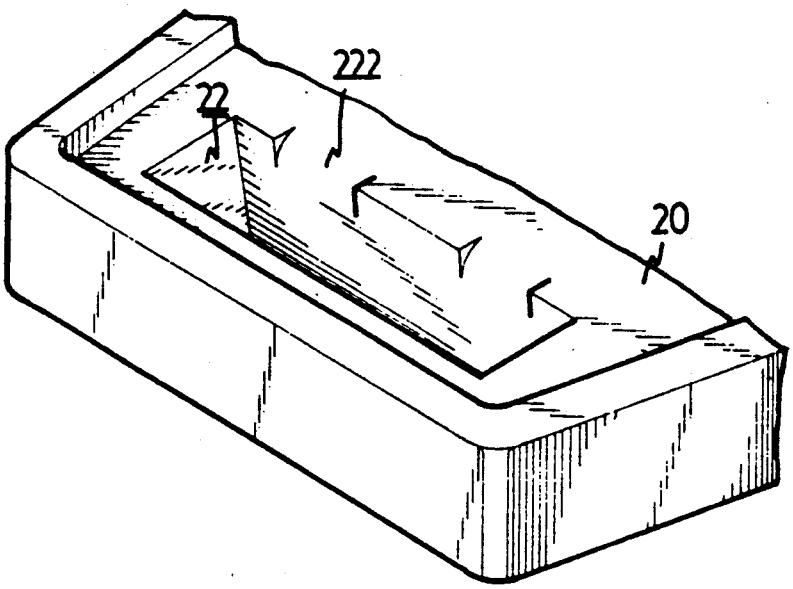
FIG. 3 is a partial perspective view of an end portion of the tool box.

Referring next to FIGS. 2 and 3 and again to FIG. 1, a plurality of slots 21 are laterally formed in the upper surfaces of the casings 20 for receiving the middle portions of the wrenches 30. The widths of the slots 21 may be varied according to the sizes of the wrenches 30. It s preferable that each of the casings 20 has a trapezoid shape in which the two sides thereof tapering from the inner side toward the free end thereof so that the wrenches 30 can be arranged in series from large to small. The sizes of the casings 20 are designed and predetermined so that both ends of the wrenches 30 extend beyond the casings 20 and so that the sizes of the wrenches 30 can be easily seen when the tool box if folded to a close state. An opening 22 is formed in the free end of each of the casings 20. Two round fillet portions 222 are formed on the upper and inner edge of the opening 22. Two holes 23 are formed in the inner end of each of the casings 20 and two cavities 231 are formed in the outer ends of the respective holes 23.

The retaining device 10 has two legs 12 resiliently coupled together by a retaining portion 11 so as to form a shape similar to that of the casing 20. An extension 13 is formed on the free end of each of the legs 12 and can be received within a respective cavity 231. The retaining device 10 is resilient and the free ends of the legs 12 are arranged such that the extensions 13 can be stably engaged within the cavities 231 by the resilient force of the legs 12 and such that the retaining device 10 is pivotally rotatable about the extensions 13. A plurality of bent portions 121 are formed on each of the legs 12 corresponding to the slots 21 of the casings 20. The retaining portion 11 includes two U-shaped resilient portions 111 insertable into and engageable with the opening 22 of the casing 20 and an inverted U-shaped portion 112. The round fillets 222 are provided for facilitating an insertion of the retaining portion 11.

Figure 4:
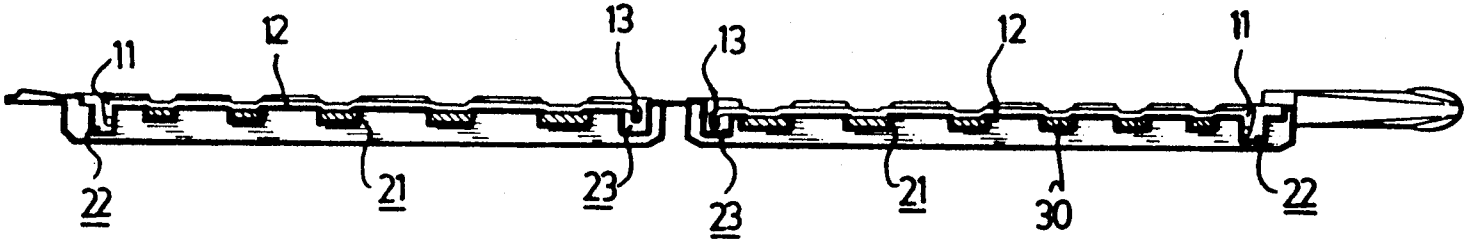
FIG. 4 is a side view of the tool box.

As is best shown in FIG. 4, the portion 112 slightly extends upward beyond the opening 22 when the portions 111 are engaged in the opening 22 so that the retaining portion 11 can be disengaged from the opening 22 when the portion 112 is pulled upward. The bent portions 121 of the retaining device 10 are engaged within the slots 21 when the retaining portion 11 is engaged within the opening 22 so that the wrenches 30 can be pressed within the slots 21 by the resilient force of the legs 12. Accordingly, the tools 30 can be stably retained within the tool box by the retaining device 10.

Figure 5:
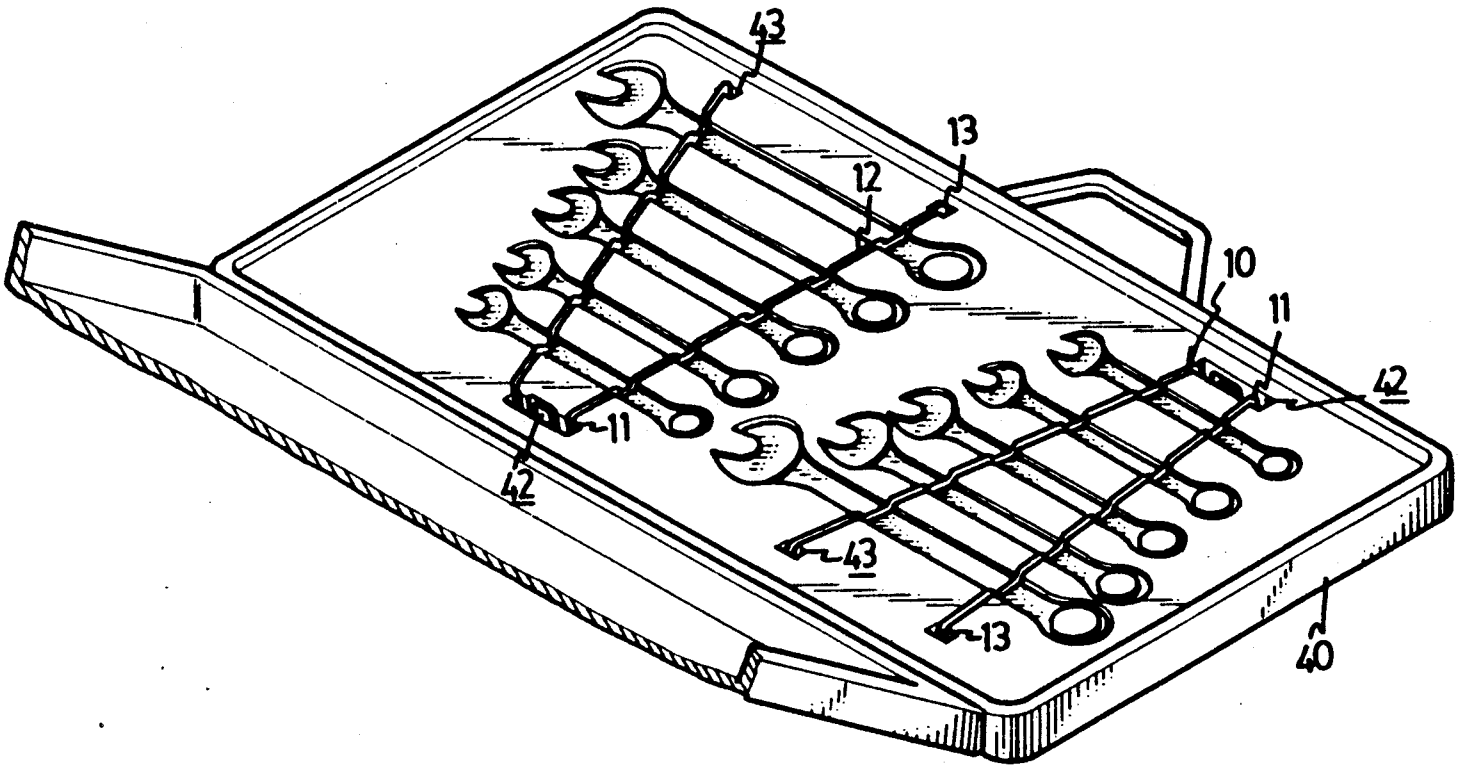
FIG. 5 is a partial perspective view of another tool box employing the retaining device.

Alternatively, as shown in FIG. 5, the retaining device 10 can be employed in a conventional tool box 40. An opening 42 and two holes 43 are formed in the upper surface of a filler material of the tool box 40 similar to to the opening 22 and the holes 23 shown in FIGS. 1 to 4. The extensions 13 are engageable within the holes 43 and the retaining portion 11 is engageable within the opening 42 so that the tools 30 can be stably retained within the tool box 40.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising two casings each having a first and second end, said first ends being connected together by a flexible element so that said casings are foldable to a position facing each other and the second ends are detachably coupled together by a retaining member, a plurality of slots being laterally formed in an upper surface of each of said casings for receiving a plurality of tools therein, an opening being formed in a free end of each of said casings, two holes being formed in an inner end of each of said casings opposite to said free end thereof, a cavity being formed in each of said holes; a retaining device including two legs resiliently coupled together by a retaining portion, an extension being formed on a free end of each of said legs and extending outward from said legs, said extensions being rotatably engaged in said cavities so that said retaining device is rotatable about said extensions, said retaining portion being engageable within said opening so that said retaining device can be retained in place, a plurality of being portions being formed on said legs of said retaining device and being arranged such that said bent portions will be engaged within said slots of said casings in order that said tools can be stably pressed in place by said retaining device.

2. A tool box according to claim 1, wherein said casing is trapezoidal in shape, said free end of said casing is narrower than said inner end thereof, said casings are arranged such that both ends of said tools are extended outward from said casings so that said tools can be seen directly when said casings are folded to a closed state.

3. A tool box according to claim 1, wherein said retaining portion includes two first portions which are U-shaped and a second portion which has an inverted U-shaped continuously formed together, said first portions are located at a lower end of said retaining portion and are engageable within said opening, said second portion is located between said first portions and extends slightly beyond said opening when said first portions are engaged within said opening, said retaining portion can be easily released from engagement with said opening when said second portion is pulled upward.

4. A tool box comprising a plurality of slots laterally formed in an upper surface of a filler material for receiving a plurality of tools therein an opening and two holes being formed in said upper surface of said filler material and being located close to both sides of said slots, a cavity being formed in each of said holes; a retaining device including two legs resiliently coupled together by a retaining portion, an extension being formed on a free end of each of said legs and extending outward from said leg, said extensions being rotatably engaged in said cavities so that said retaining device is rotatable about said extensions, said retaining portion being engageable within said opening so that said retaining device can be retained in place, a plurality of bent portions being formed on said legs of said retaining device and being arranged such that said bent portions will be engaged within said slots of said casings in order to press said tools in place.

* * * * *